US010309050B2

(12) United States Patent
Lee et al.

(10) Patent No.: US 10,309,050 B2
(45) Date of Patent: Jun. 4, 2019

(54) LAUNDRY TREATING APPARATUS

(71) Applicant: LG ELECTRONICS INC., Seoul (KR)

(72) Inventors: Deukwon Lee, Seoul (KR); Kyoungmin Choi, Seoul (KR); Hoon Chang, Seoul (KR); Dongwoo Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 162 days.

(21) Appl. No.: 15/214,705

(22) Filed: Jul. 20, 2016

(65) Prior Publication Data

US 2017/0022652 A1 Jan. 26, 2017

(30) Foreign Application Priority Data

Jul. 21, 2015 (KR) ..... 10-2015-0103110

(51) Int. Cl.
*D06F 39/10* (2006.01)
*D06F 23/04* (2006.01)

(52) U.S. Cl.
CPC ..... *D06F 39/10* (2013.01); *D06F 23/04* (2013.01)

(58) Field of Classification Search
None
See application file for complete search history.

(56) References Cited

U.S. PATENT DOCUMENTS 5,989,418 A * 11/1999 Shin ..... D06F 39/10 210/136
2007/0295035 A1* 12/2007 Lim ..... D06F 37/04 68/3 R (Continued)

FOREIGN PATENT DOCUMENTS

CN 1208787 2/1999
JP 63-107696 7/1988

(Continued)

OTHER PUBLICATIONS

PCT International Search Report dated Oct. 18, 2016 issued in Application No. PCT/KR2016/007896.

(Continued)

*Primary Examiner* — Jason Y Ko
*Assistant Examiner* — Cristi J Tate-Sims
(74) *Attorney, Agent, or Firm* — Ked & Associates, LLP

(57) ABSTRACT

A laundry treating apparatus may include a tub, a drum provided within the tub to accommodate laundry, flow path units provided on the drum to provide moving paths of water, an agitation unit provided within the drum so as to be rotatable and moving at least a part of water within the drum to the flow path units during rotation, and filter units to filter water moving along the flow path units. Each of the filter units includes a body configured to provide a storage space of foreign substances, an inflow part to introduce water in the flow path unit into the body, a filter provided on the body to filter water introduced into the body and then to discharge filtered water to the drum, and discharge parts provided on the body to discharge water containing foreign substances in the tangential direction of a rotating trajectory of the drum.

16 Claims, 4 Drawing Sheets

(56) References Cited

U.S. PATENT DOCUMENTS

| | | | | |
|---|---|---|---|---|
| 2008/0216518 | A1* | 9/2008 | Yoo | D06F 39/10 68/12.13 |
| 2008/0282747 | A1* | 11/2008 | Kim | D06F 37/06 68/13 R |
| 2009/0235960 | A1* | 9/2009 | Yoo | D06F 37/12 134/110 |

FOREIGN PATENT DOCUMENTS

| | | |
|---|---|---|
| JP | 2013-141552 | 7/2013 |
| KR | 10-2003-0066936 | 8/2003 |
| KR | 10-2004-0078232 | 9/2004 |
| KR | 10-2004-0078233 | 9/2004 |
| KR | 10-0507061 | 9/2004 |
| KR | 10-0502010 | 7/2005 |
| KR | 10-2011-0063062 | 6/2011 |
| WO | WO 2008/140169 | 11/2008 |

OTHER PUBLICATIONS

European Search Report dated Dec. 1, 2016 issued in Application No. 16179924.2.

Chinese Office Action (with English Translation) dated Mar. 5, 2018 issued in Chinese Application No. 201610579942.9.

* cited by examiner

LAUNDRY TREATING APPARATUS

CROSS-REFERENCE TO RELATED APPLICATION(S)

This application claims priority under 35 U.S.C. § 119 to Korean Patent Application No. 10-2015-0103110 filed on Jul. 21, 2015, whose entire disclosure is hereby incorporated by reference.

BACKGROUND

1. Field

The present disclosure relates to a laundry treating apparatus.

2. Background

In general, laundry treating apparatuses refer to apparatuses to wash laundry, and a conventional laundry treating apparatus includes a cabinet forming the external appearance of the laundry treating apparatus, a tub provided within the cabinet to store water, a drum provided within the tub to accommodate laundry, and an agitation unit provided within the drum so as to be rotatable and forming a water stream. Among conventional laundry treating apparatuses, there is a laundry treating apparatus including flow path units provided on a drum to move water to the upper portion of the drum during rotation of an agitation unit, and filter units provided on the flow path units to filter water.

Since the filter units of the conventional laundry treating apparatus are provided in a mesh type, the mesh-type filter unit may be damaged due to collision with laundry during washing. Further, in the conventional laundry apparatus, if the mesh-type filter unit is torn, foreign substances remaining in the mesh-type filter unit may be re-introduced into the drum. Moreover, the mesh-type filter units may just filter out foreign substances from washing water but may not spray washing water to laundry, thereby causing a difficulty in increasing washing efficiency.

BRIEF DESCRIPTION OF THE DRAWINGS

The embodiments will be described in detail with reference to the following drawings in which like reference numerals refer to like elements wherein.

DETAILED DESCRIPTION

Figure 1:
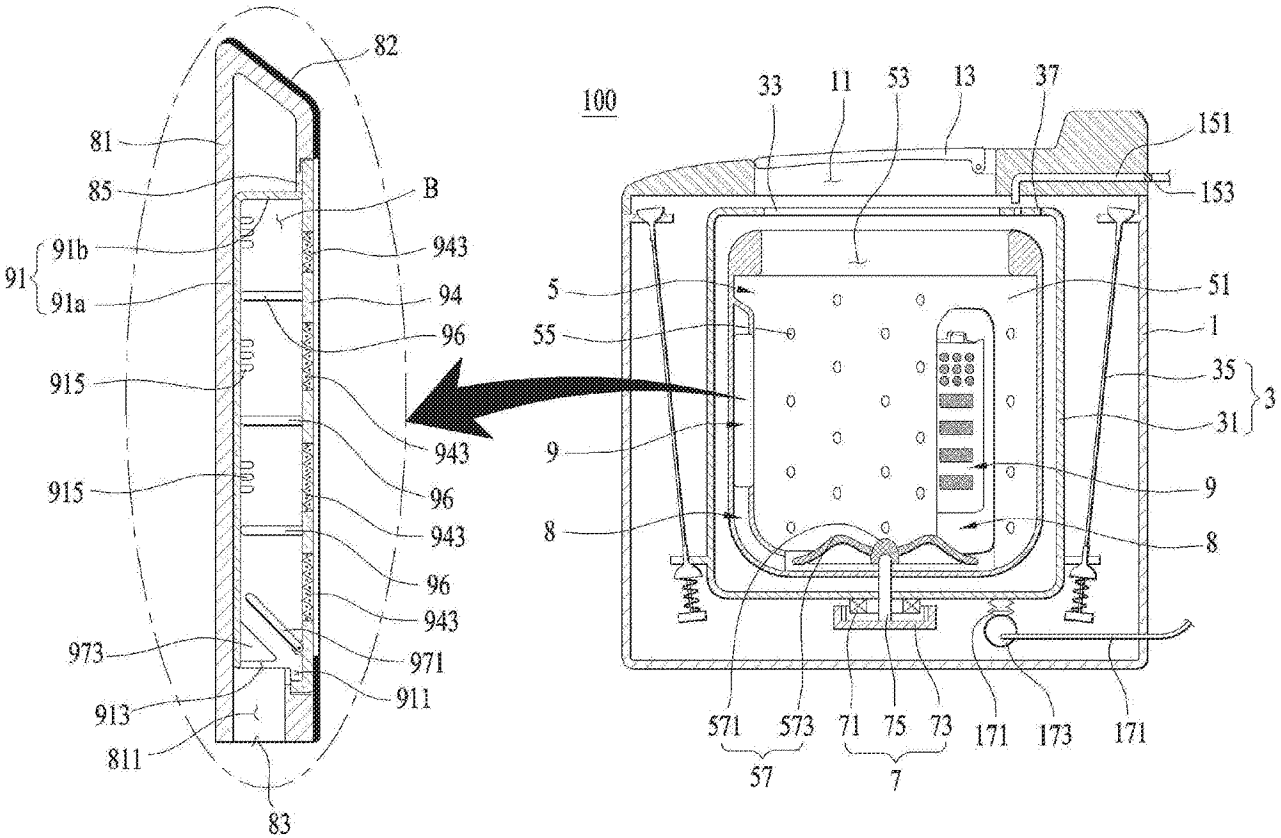
FIG. 1 is a view exemplarily illustrating a laundry treating apparatus in accordance with the present disclosure.

As exemplarily shown in FIG. 1, a laundry treating apparatus 100 in accordance with the present disclosure may include a cabinet 1, a tub 3 provided within the cabinet 1 to store water, and a drum 5 provided within the tub 3 to accommodate laundry. An inlet 11 to put laundry into the drum 5 or take laundry out of the drum 5 and a door 15 to open and close the inlet 11 are provided on the cabinet 1. The tub 3 may include a tub body 31 to provide a water storage space, and the tub body 31 is fixed to the cabinet 1 through tub supports 35. A tub inlet 33 communicating with the inlet 11 is provided on the upper surface of the tub body 31.

The tub body 31 receives water through a water supply unit, and the water supply unit may include a water supply pipe 151 connected to a water supply source, and a valve 153 to open and close the water supply pipe 151. If the water supply pipe 151 is located above the tub body 31, a water supply hole 37, through which water supplied from the water supply pipe 151 is introduced into the inside of the tub body 31, may be further provided on the tub body 31. The water supply hole 37 may pass through the upper surface of the tub body 31. Water stored in the tub body 31 is discharged to the outside of the cabinet 1 through a drain unit, and the drain unit may include a drain pipe 171 to guide water in the tub body 31 to the outside of the cabinet 1 and a drain pump 173.

The drum 5 may include a drum body 51 to provide a laundry accommodation space. The drum body 51 may be provided within the tub body 31 so as to be rotatable, and the drum body 51 communicates with the inlet 11 through a drum inlet 53. A plurality of drum through holes 55, through which water in the tub body 31 is introduced into the inside of the drum body 51, is provided on the cylindrical surface and bottom surface of the drum body 51.

An agitation unit (also referred to as a pulsator or an impellor) 57 rotating within the drum body 51 may be further provided in the drum 5. When the agitation unit 57 is rotated, a water stream is formed within the drum body 51.

The agitation unit 57 is rotated by a driving unit 7, and the driving unit 7 may include a stator 71 fixed to the outer surface of the tub body 31 and generating a rotating magnetic field, a rotor 73 rotated by the rotating magnetic field, and a rotary shaft 75 passing through the bottom surface of the tub body 31 to connect the agitation unit 57 to the rotor 73. The rotary shaft 75 may be provided to be perpendicular to the bottom surface of the tub body 31, and the agitation unit 57 may include a hub 571 fixed to the rotary shaft 75 and vanes 573 disposed radially around the tub 571. Therefore, when the agitation unit 57 is rotated by the driving unit 7, water stored within the drum body 51 moves in the rotating direction of the vanes 573 in the drum body 51. Although not shown in the drawings, the laundry treating apparatus 100 of the present disclosure may further include a drum driving unit to rotate the drum 5.

The laundry treating apparatus 100 of the present disclosure may further include flow path units (or flow paths) 8 to move water in the drum body 51 from the lower portion of the drum 5 to the upper portion of the drum 5 during rotation of the agitation unit 57, and filter units (or filter assemblies) 9 to filter water introduced from the flow path units 8 and then to discharge the filtered water to the drum 5. The flow path unit 8 may include a flow path body 81 provided on the drum body 51 and extending from the lower portion of the drum 5 to the upper portion of the drum 5, and a supply path 811 provided on the flow path body 81 to supply water to the filter unit 9. The flow path body 81 may be fixed to the drum body 51 so as to form the inner circumferential surface of the drum 5.

Figure 2:
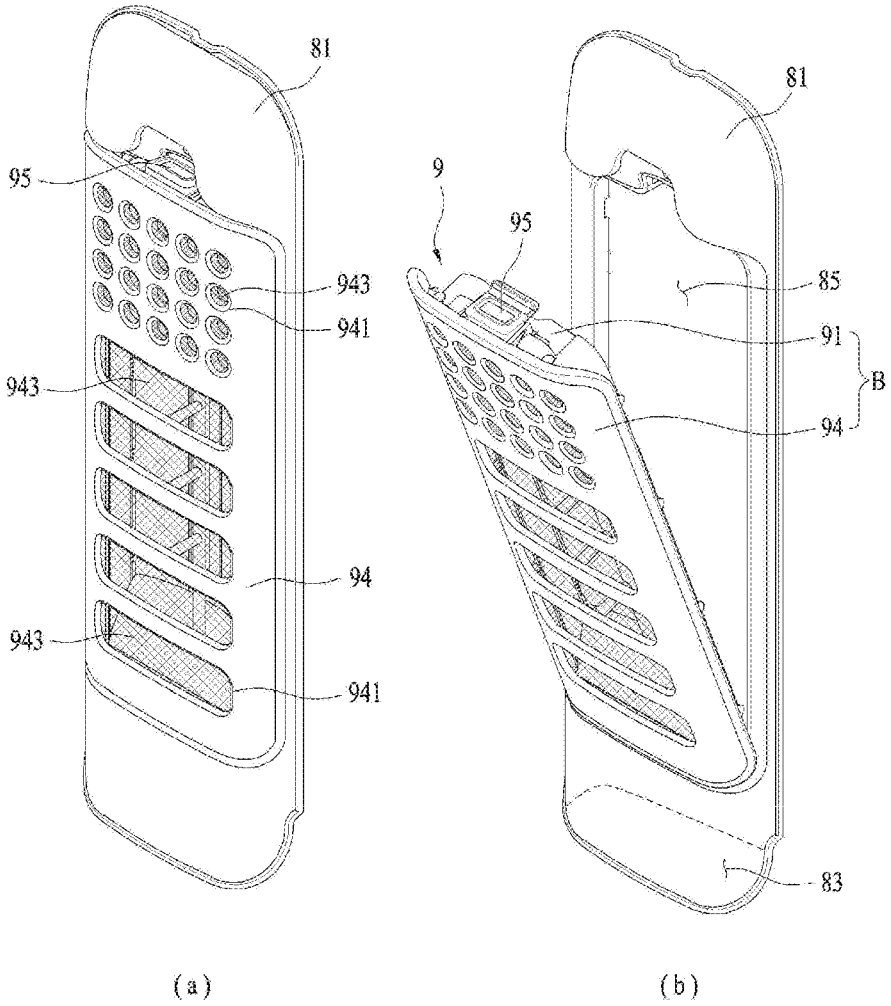
FIG. 2 shows views illustrating a filter unit and a flow path unit.

As exemplarily shown in FIG. 2, the flow path body 81 may include an opening 83 through which water is supplied to the supply path 811, and an attachment part 85 with which the filter unit 9 is detachably combined. The flow path body 81 may have a hexahedral shape. In this case, the opening 83 may be provided as a hole passing through the bottom surface of the flow path body 81, and the attachment part 85 may be provided as a hole provided on a surface of the flow path body 81, facing the center of rotation of the drum 5, so that the filter unit 9 is inserted into the attachment part 85.

If the flow path unit 8 is provided so as to form the inner circumferential surface of the drum body 51, the flow path body 81 may be formed of the same material as a material of the drum 5. For example, if the drum 5 is formed of stainless steel, the flow path body 81 may be formed of stainless steel. If the material of the drum 5 and the material of the flow path body 81 forming the inner circumferential surface of the drum 5 are the same, unity in design is achieved and thus internal aesthetics of the laundry treating apparatus 100 may be increased.

The above-described effect may be implemented through the flow path body 81 formed of a material, such as plastic, and a body cover 82 formed of the same material as the material of the drum 5 and covering the surface of the flow path body 81 (with reference to FIG. 1). In this case, the body cover 82 may be provided at only a surface forming the inner circumferential surface of the drum body 51 among the surfaces of the flow path body 81.

The meaning that the body cover 82 is formed of the same material as the material of the drum body 51 includes not only that the body cover 82 and the drum body 51 are formed of the same material but also that the body cover 82 and the drum body 51 are not formed of the same material and are formed of metals of the same series. That is, the meaning that the body cover 82 is formed of the same material as the material of the drum body 51 even includes that a component ratio of stainless steel used to manufacture the drum body 51 differs from a component ratio of stainless steel used to manufacture the body cover 82. Unity in design of the laundry treating apparatus 100 may be maximized if the materials of the drum body 61, the agitation unit 57 and the flow path units 8 are the same.

The filter unit 9 includes a body B combined with the flow path body 81 through the attachment part 85, an inflow part (or inflow ports) 913 provided on the body B to introduce water supplied to the supply path 811 to the inside of the body B, a filter 943 to filter water introduced into the body B and then to discharge the filtered water to the drum body 51, and a handle 95 to detachably fix the body B to the flow path body 81. As exemplarily shown in FIG. 3, the body B includes a first body 91 located within the flow path body 81, and a second body 94 provided on the first body 91 so as to be rotatable and supporting the filter 943. The first body 91 and the second body 94 may be combined through hinges 911. Therefore, a user may remove foreign substances stored in the body B by rotating the first body 91 and the second body 94 away from each other. The first body 91 may include a base 91*a* provided in parallel with the flow path body 81, and a flange 91*b* protruding from the base 91*a* toward the second body 94 and surrounding the filter 943. In this case, the inflow part 913 may pass through the flange 91*b*.

The second body 94 is combined with the first body 91 to form the inner circumferential surface of the drum body 51, and a plurality of through holes 941 to communicate the inside of the body B with the inside of the drum 5 is provided on the second body 94. In this case, the filter 943 may be provided as a mesh provided in the through holes 941. The filter 943 is provided only on a surface forming the inner circumferential surface of the drum 5, among surfaces formed by the body B. If, among the surfaces formed by the body B, the filter 943 is formed only on the surface forming the inner circumferential surface of the drum 5, pressure of water discharged from the filter 943 may be increased, as compared to a case in that filters are formed on various surfaces of the body B. When the pressure of water discharged from the filter 943 is increased, water may be strongly sprayed onto laundry accommodated in the drum 5 during rotation of the agitation unit 57. Therefore, the laundry treating apparatus 100 of the present disclosure may have high washing ability.

A backflow prevention unit 97 is provided at the inflow part 913. The backflow prevention unit 97 is provided on any one of the first body 91 and the second body 94 and serves to open and close the inflow part 913. However, in order to prevent water introduced into the body B from being discharged to the outside of the body B through the inflow part 913, the backflow prevention unit 97 is provided so as to be rotatable only toward the inside of the body B.

Figure 3:
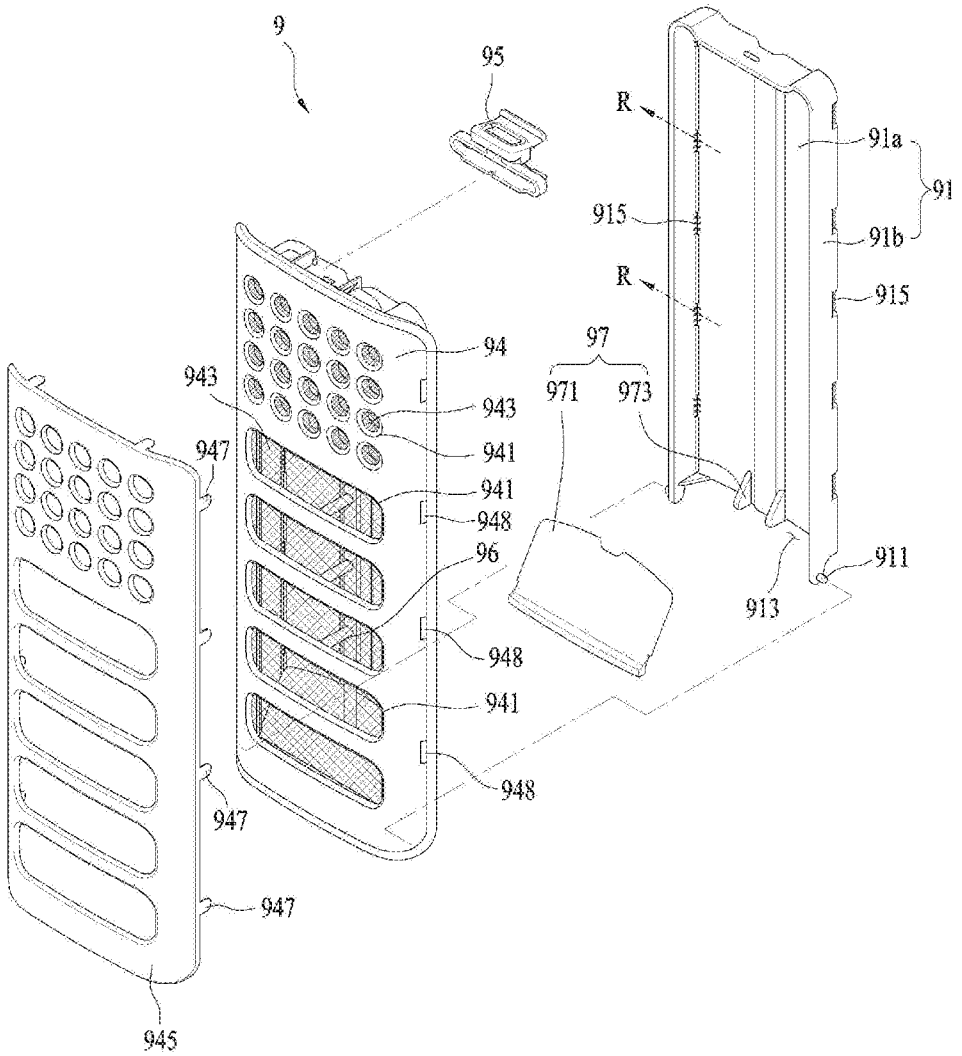
FIGS. 3 and 4 are views illustrating an exemplary filter unit.

FIG. 3 exemplarily illustrates a case that the backflow prevention unit 97 includes a valve body (or backflow prevention flap) 971 provided on the second body 94 so as to be rotatable and opening and closing the inflow part 913, and stoppers 973 provided on the base 91*a* of the first body 91 to prevent the valve body 971 from being rotated toward the outside of the body B. The valve body 971 may be formed of an elastic material, such as rubber. In spite of presence of the stoppers 973, when the amount of foreign substances stored in the body B increases, there is a possibility that the valve body 971 is rotated toward the outside of the body B and discharges foreign substances stored in the body B to the outside of the body B. In order to prevent such a problem, support parts 96, to which the foreign substances stored in the body B may be fixed, may be further provided between the first body 91 and the second body 94. The support parts 96 may protrude from one of the first body 91 and the second body 92 toward the other of the first body 91 and the second body 92. FIG. 3 exemplarily shows the support parts 96 provided on the second body 94. If the support parts 96 protrude from the second body 94 and contact the first body 91, the support parts 96 may also serve to maintain an interval between the first body 91 and the second body 94.

The filter unit 9 having the above-described structure may further include discharge parts (or discharge ports) 915 to discharge water containing foreign substances to the outside of the body B during a spin-drying operation in which the drum 5 is rotated to discharge water from laundry to the tub 3. The discharge parts 915 of the present disclosure discharge water containing foreign substances in the tangential direction (R) of a rotating trajectory of the drum 5. That is, the discharge parts 915 are provided on the flange 91*b* forming the side surfaces of the first body 91.

In order to achieve unity in design, the second body 94 forming the inner circumferential surface of the drum body 51 may be formed of the same material as the material of the drum body 51. That is, the drum body 51 and the agitation unit 57 may be formed of stainless steel. The above effect may be achieved by providing a cover 945 formed of the same material as the material of the drum 5 on the surface of the second body 94. The cover 945 may be provided to surround only a surface forming the inner surface of the drum body 51 among surfaces of the second body 94. In this case, the drum body 51, the agitation unit 57 and the cover 945 may be formed of the same material (stainless steel, etc.). The meaning that the cover 945 is formed of the same material as the material of the drum body 51 includes not only that the cover 945 and the drum body 51 are formed of the same material but also that the cover 945 and the drum body 51 are not formed of the same material and are formed of metals of the same series. That is, the meaning that the cover 945 is formed of the same material as the material of the drum body 51 even includes that a component ratio of stainless steel used to manufacture the drum body 51 differs from a component ratio of stainless steel used to manufacture the cover 945. If the second body 94 forms the inner circumferential surface of the drum body 51, the cover 945 may have the same shape as the shape of the second body 94.

Figure 4:
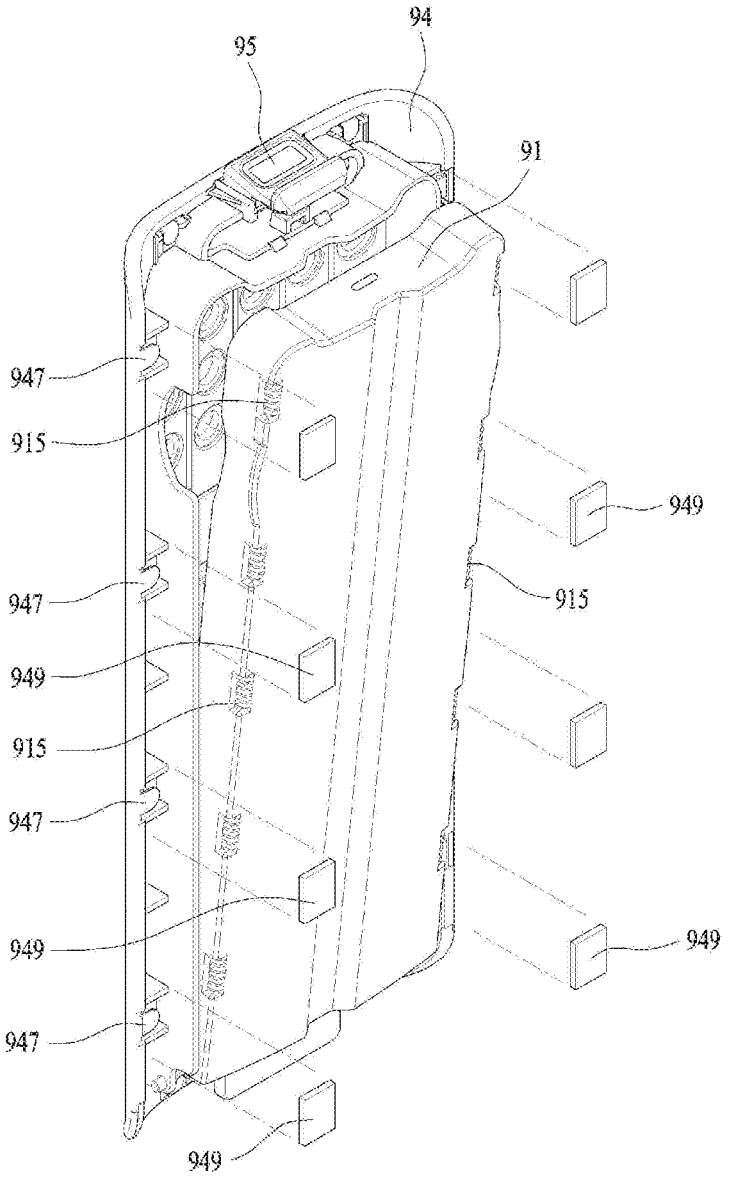

In order to combine the cover 945 with the second body 94, fastening protrusions 947 protruding toward the second body 94 may be provided on the cover 945 and fastening holes 948, into which the fastening protrusions 947 are inserted, may be provided on the second body 94. As exemplarily shown in FIG. 4, the fastening protrusions 947 are inserted into the fastening holes 948 and then bent, thereby fixing the cover 945 to the second body 94. In order to prevent safety accidents, the fastening protrusions 947 may not be exposed to the outside by fastening hole covers 949. The fastening hole covers 949 are detachably fixed to the rear surface of the second body 94.

As is apparent from the above description, the present disclosure provides a laundry treating apparatus having filter devices to filter water. Further, the present disclosure provides a laundry treating apparatus having filter units which may execute both a function of filtering water and a function of spraying water to laundry. Moreover, the present disclosure provides a laundry treating apparatus having filter units with an outer surface formed of a material which is the same as or similar to a material of a drum.

It will be apparent to those skilled in the art that various modifications and variations can be made in the present disclosure without departing from the spirit or scope of the disclosure. Thus, it is intended that the present disclosure cover the modifications and variations of this disclosure provided they come within the scope of the appended claims and their equivalents.

Accordingly, the present disclosure is directed to a laundry treating apparatus that substantially obviates one or more problems due to limitations and disadvantages of the related art. An object of the present disclosure is to provide a laundry treating apparatus having filter devices to filter water. Another object of the present disclosure is to provide a laundry treating apparatus having filter units which may execute both a function of filtering water and a function of spraying water to laundry. Yet another object of the present disclosure is to provide a laundry treating apparatus having filter units with an outer surface formed of a material which is the same as or similar to a material of a drum.

A laundry treating apparatus may include a tub configured to store water, a drum provided within the tub to accommodate laundry, flow path units provided on the drum to provide moving paths of water, an agitation unit provided within the drum so as to be rotatable and moving at least a part of water within the drum to the flow path units during rotation, and filter units to filter water moving along the flow path units, wherein each of the filter units includes a body configured to provide a storage space of foreign substances, an inflow part to introduce water in the flow path unit into the body, a filter provided on the body to filter water introduced into the body and then to discharge filtered water to the drum, and discharge parts provided on the body to discharge water containing foreign substances in the tangential direction of a rotating trajectory of the drum.

The filter may be provided only on a surface forming the inner circumferential surface among surfaces formed by the body. The body may include a first body detachably attached to the flow path unit and including the inflow part and the discharge parts, and a second body combined with the first body so as to be rotatable and forming the inner circumferential surface of the drum, the filter being fixed to the second body. The first body may include a base provided in parallel with the flow path unit and a flange protruding from the base toward the second body and surrounding the filter, and the inflow part and the discharge parts may pass through the flange.

The laundry treating apparatus may further include a cover formed of the same material as the material of the drum and fixed to the surface of the second body. The cover may surround a surface forming the inner circumferential surface of the drum among the surfaces of the second body. The drum and the cover may be formed of stainless steel. A component ratio of stainless steel used to manufacture the drum may differ from a component ratio of stainless steel used to manufacture the cover. The drum, the agitation unit and the cover may be formed of stainless steel. The second body may be formed of the same material as the material of the drum.

The laundry treating apparatus may further include a backflow prevention unit provided on any one of the first body and the second body so as to open and close the inflow part, and being rotatable only toward the inside of the body. The laundry treating apparatus may further include support parts protruding from one of the first body and the second body toward the other of the first body and the second body.

Each of the flow path units may include a flow path body extending from the lower portion of the drum toward the upper portion of the drum, forming the inner circumferential surface of the drum and formed of the same material as the material of the drum, and a supply path configured to guide water, introduced into the flow path body, to the inflow part. Each of the flow path units may include a flow path body extending from the lower portion of the drum toward the upper portion of the drum, a supply path configured to guide water in the flow path body to the inflow part, and a body cover formed of the same material as the material of the drum and fixed to the surface of the flow path body. The drum, the body cover and the agitation unit may be formed of stainless steel.

It is to be understood that both the foregoing general description and the following detailed description of the present disclosure are exemplary and explanatory and are intended to provide further explanation of the disclosure as claimed. Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus comprising:

a tub configured to store water;

a drum provided within the tub and configured to accommodate laundry;

a flow path provided on an outer surface of the drum;

an impellor provided within the drum, wherein the impellor is configured to be rotatable and to move at least a part of water within the drum toward the flow path; and a filter assembly configured to filter water moving through the flow path, wherein the filter assembly includes:

a body configured to provide a storage space;

an inflow port formed at a lower side of the body and configured to introduce water from the flow path into the body;

a backflow prevention flap provided in an interior of the body, the backflow prevention flap including a first end that is rotatably coupled to the body and second end that moves in the interior of the body to selectively open or close a flow of water through the inflow port;

a filter coupled to the body, wherein the filter is configured to filter water introduced into the body and to discharge the filtered portion of the water to the drum; and a discharge port formed in of the body, and configured to discharge an unfiltered portion of the water in the storage space out of the body, wherein the body includes:

a first body detachably attached to the flow path and including a base provided with the flow path, and a flange protruding from the base toward a second body and surrounding the filter; and the second body coupled to the first body and forming a portion of an inner circumferential surface of the drum, the filter being coupled to the second body, and wherein the discharge port is provided on the flange forming side surfaces of the first body to discharge water in a tangential direction of a rotating trajectory of the drum during a spin-drying operation in which the drum is rotated to discharge water from laundry to the tub.

2. The laundry treating apparatus according to claim 1, wherein the filter is provided on an inner circumferential surface included in the body.

3. The laundry treating apparatus according to claim 1 further comprising a cover formed of a same material as the drum and coupled to the second body.

4. The laundry treating apparatus according to claim 3, wherein the drum and the cover are formed of stainless steel.

5. The laundry treating apparatus according to claim 3, wherein the drum, the impellor, and the cover are formed of stainless steel.

6. The laundry treating apparatus according to claim 1, wherein the second body is formed of a same material as the drum.

7. The laundry treating apparatus according to claim 1, further comprising one or more supports protruding from one of the first body or the second body toward another one of the first body or the second body.

8. The laundry treating apparatus according to claim 1, wherein the flow path includes:

a flow path body extending from a lower portion of the drum and toward an upper portion of the drum, the flow path body forming the inner circumferential surface of the drum and being formed of a same material as the drum; and a supply path configured to guide water, introduced into the flow path body, to the inflow port.

9. The laundry treating apparatus according to claim 1, wherein the flow path includes:

a flow path body extending from a lower portion of the drum and toward an upper portion of the drum;

a supply path configured to guide water in the flow path body toward the inflow port; and a body cover formed of a same material as the drum and coupled to a surface of the flow path body.

10. The laundry treating apparatus according to claim 9, wherein the drum, the body cover, and the impellor are formed of stainless steel.

11. The laundry treating apparatus according to claim 1, wherein the second body includes fastening protrusions, and the first body includes fastening holes to receive the fastening protrusions, and wherein the fastening protrusions are inserted into the fastening protrusions to couple the second body to the first body.

12. The laundry treating apparatus according to claim 11, wherein the filter assembly further includes fastening hole covers that cover the fastening protrusions when inserted into the fastening protrusions.

13. The laundry treating apparatus according to claim 1, wherein the body includes a stopper that extends from the rear side of the body and prevents the backflow prevention flap from being rotated toward an exterior of the body.

14. The laundry treating apparatus according to claim 1, wherein the filter includes a mesh screen.

15. The laundry treating apparatus of claim 1, wherein the body includes a plurality of holes that communicate an inside of the body to an inside of the drum, and the filter is positioned within the plurality of holes.

16. The laundry treating apparatus of claim 8, wherein the filter assembly includes a hinge that is configured to be inserted to the flow path body to couple the filter assembly to the flow path body, and wherein the filter assembly is configured to be rotated around the hinge for removal from the flow path body.

* * * * *